United States Patent [19]

Cutrell

[11] Patent Number: 4,967,723

[45] Date of Patent: Nov. 6, 1990

[54] BB GUN LOADER

[76] Inventor: Gary W. Cutrell, 317 Draper St., Warner Robins, Ga. 31088

[21] Appl. No.: 403,950

[22] Filed: Sep. 7, 1989

[51] Int. Cl.[5] ..... F41B 11/02

[52] U.S. Cl. ..... 124/50; 222/517

[58] Field of Search ..... 42/87; 124/45, 49, 50, 124/53; 221/296; 222/517

[56] References Cited

U.S. PATENT DOCUMENTS

| | | | |
|---|---|---|---|
| 1,489,092 | 4/1924 | Marston | 222/517 |
| 1,645,638 | 10/1927 | Abraham | 42/87 |
| 2,170,182 | 8/1939 | Anthony | 222/517 |
| 4,164,929 | 8/1979 | Liepins et al. | 124/50 |
| 4,831,998 | 5/1989 | Maguire | 124/50 |

FOREIGN PATENT DOCUMENTS

| | | | |
|---|---|---|---|
| 76367 | 1/1948 | Czechoslovakia | 221/296 |
| 1114 | 1/1907 | United Kingdom | 42/87 |

*Primary Examiner*—Stephen C. Bentley

*Attorney, Agent, or Firm*—William M. Hobby, III

[57] ABSTRACT

A BB gun loader has a rigid BB container having an open end covered by a removable cap and having the other end an outlet side to emit one BB at a time. The outlet is shaped to fit into the end of a BB gun magazine. A dispenser mechanism is a single molded piece pinned to the rigid BB container for rotation on a pair of pins responsive to the pressing of a dispenser button located on the exterior of the container to open and close a BB outlet door covering the BB outlet. A pair of leaf springs are formed into the dispenser mechanism and extend against one side of the BB container to return the BB outlet door to a closed position when the dispenser-button is released.

6 Claims, 1 Drawing Sheet

BB GUN LOADER

BACKGROUND OF THE INVENTION

The present invention relates to a container for BB's and especially to a BB gun loader for loading the magazine of a BB gun.

In the past, BB guns have been widely used and these are typically air rifles which have magazines holding a plurality of lead or metal shot, commonly referred to as BB's. Such air rifles or BB guns have magazines which allow the insertion of a single BB at a time which can be a slow process in the filling of the BB magazine. Once the BB's are loaded in the magazine, they are inserted one at a time into the chamber for firing out of the barrel. The present invention relates to a BB gun loader which can be loaded and stored in a rigid container which is reusable and which can insert BB's one at a time into the air gun magazine or which can insert the BB's in a continuous stream.

One prior art air gun which shoots BB's and includes a magazine is shown in the Markham U.S. Pat. No. 557,849, while another BB gun with a special loading magazine is shown in the Sproull U.S. Pat. No. 1,152,447. A prior art BB gun/shot container and dispenser and filler can be seen in the Bauer et al. U.S. Pat. No. 4,020,974 which has a container for BB's and a tube dispenser for dispensing the BB's one at a time and is intended to obviate the common practice among children of placing BB shots in their mouth and filling the magazine of the air rifle by pressing their lips against it and expelling the BB's into the air rifle. Another BB gun loader can be seen in the Bauer et al. U.S. Pat. No. 3,263,664 which operates similar to the other Bauer patent except it loads the BB's single file down a tube out one end of a BB container. The dispensing mechanism in these patents expands a rubber lip by grasping a special handle and sliding the lip over the tube to open the tube. A common vending machine for dispensing balls can be seen in the Linsley U.S. Pat. No. 862,923.

The present invention advantageously provides a rigid container which is shaped for being gripped by the hand and allows the thumb to release one or a series of BB's and which BB loader has a dispensing mechanism formed as one element pinned a rigid container.

SUMMARY OF THE INVENTION

A BB gun or air rifle loader has a rigid BB container having an open end covered by a removable cap and allowing the container to be loaded with BB's. The container has a BB outlet sized to admit one BB at a time and shaped to fit into an air gun BB magazine. A dispenser mechanism is formed of one molded component which is pinned to the rigid container with a pair of pins and has a dispenser button located on the exterior of the container and a BB outlet door covering the BB outlet so that rotating the dispenser member on the pins by pushing the dispenser button moves the BB outlet door to open or close the BB outlet. A pair of leaf springs is molded into the dispenser member and extends down against a wall of the rigid container to maintain the BB dispenser door in a closed position and to return the BB door to the closed position when the dispenser button is released. The rigid container is shaped for holding in the hand with the thumb placed on the dispenser button and the fingers on an arcuate surface shaped for either left or right handed use.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
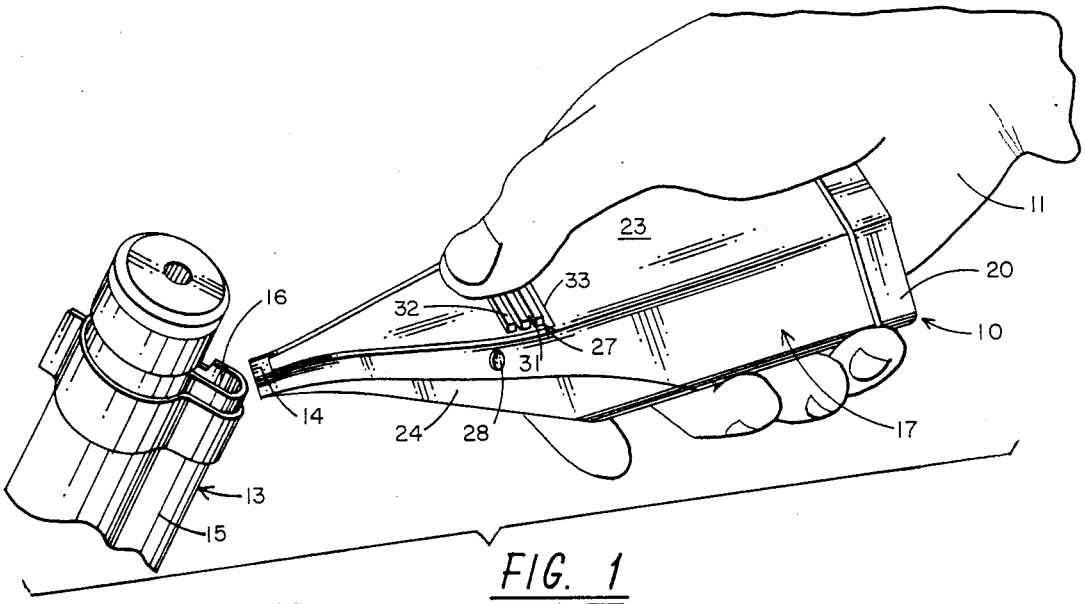
FIG. 1 is a perspective view of a BB gun loader being positioned onto a BB gun magazine.

Referring to the drawings and especially FIGS. 1 through 5, a BB gun loader 10 is shown held in an individual' hand 11 in FIG. 1 adjacent a BB gun or air rifle 13 with the outlet end 14 of the BB gun loader 10 adjacent the magazine 15 opening 16. The BB gun loader 10 has a rigid storage or loading container 17 for BB's having an open end covered by a removable cap 20 having a ridge 21 therearound for snapping into a groove 22 extending around the end of the container 17.

Figure 2:
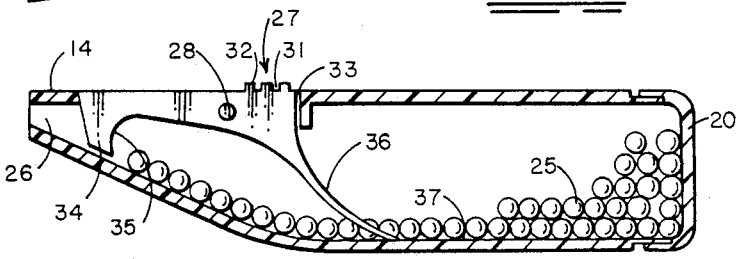
FIG. 2 is a sectional view taken through the BB gun loader of FIG. 1.
Figure 4:
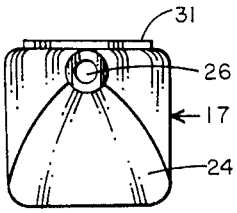
FIG. 4 is a front elevation of a BB gun loader in accordance with the present invention.
Figure 3:
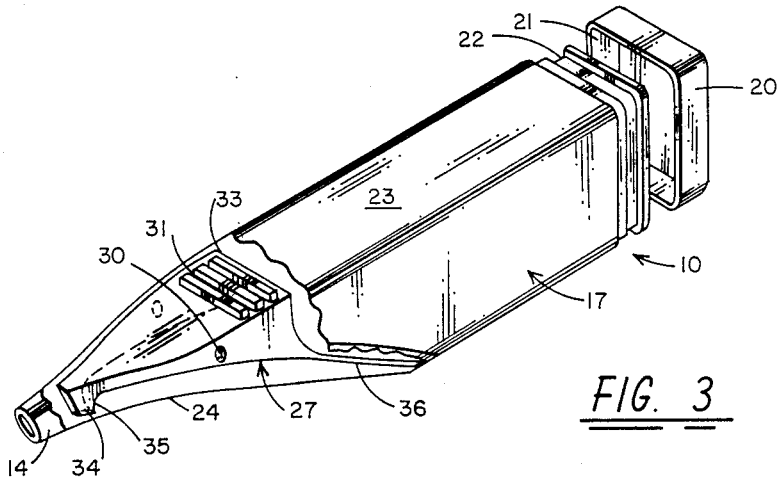
FIG. 3 is a cutaway perspective view of a BB gun loader in accordance with FIGS. 1 and 2.
Figure 5:
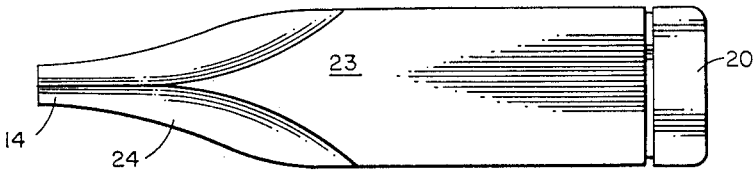
FIG. 5 is a bottom elevation of the BB gun loader in accordance with FIGS. 1 through 4.

Container 17 has the BB loading outlet end 14 and is generally of a square shape in the storage end 23 but has a pair of arcuate narrowing surfaces 24 shaped for placing an individual's finger against during the loading process for holding the container 17 steady. Container 17 can hold a plurality of BB shot 25 for dispensing out the outlet opening 26 and has a one piece molded dispenser mechanism 27 which can be molded of a polymer material and can be pinned with a pair of pins 28 or which can be a single pin passing through the container 17 and through an opening 30 in the dispenser mechanism 27. Dispenser mechanism 27 has a dispenser button 31 having a plurality of grooves 32 which is located on the outside of the container 17 through an enlarged opening 33 in the container 17. Dispenser mechanism 27 also has an outlet door 34 having an arcuate surface 35 on one end and which extends in front of the BB outlet opening 26. The door 34 is raised and lowered by depressing the dispenser button 31 to rotate the dispenser mechanism 27 on the pins 28. The dispenser mechanism also has an elongated leaf spring 36 having an arcuate shape and extending down and against the interior wall 37 of the rigid container 17. As shown in this embodiment, a pair of springs 36 extend down along the sides of the container 27 in order to stay out of the way of the dispensing BB's passing therebetween. The arcuate spring 36 is flexed against the wall to maintain the door 34 in a closed position as shown in FIG. 2 until the button 27 is depressed with the thumb as shown in FIG. 1 against the spring 36 to open the door 34. This allows the thumb to manipulate the button 27 to allow one or a whole series of BB's 25 to pass through the opening 26. The spring bias from the spring 36 will then automatically maintain the door 34 in a closed position.

The container 17 is shaped for an easy grip with a generally rectangular cross-section on the back and a pair of generally arcuate surfaces on the front for placing the fingers with a groove surface on the dispenser mechanism dispenser button so that the container can be held steady with the end 14 in the end of the magazine 16 during loading. However, the present invention is not to be construed as limited to the forms shown which are to be considered illustrative rather than restrictive.

I claim:

1. An air rifle BB loader comprising:

a rigid BB container having an open end and having an outlet sized to emit one BB at a time, said one end shaped to fit into an air gun BB magazine and said BB container having the loading end shaped with a pair of arcuate surfaces for supporting a person's finger thereon while gripping said container during loading of an air rifle;

a removable cap covering said open end of said container; and a dispenser mechanism movably pinned with a pin to said container, said movable dispenser mechanism having a dispenser button located on the exterior of said container connected to a BB outlet door located on the interior of said container and covering the BB outlet and rotated on said pin to open said outlet door upon pushing said dispenser button and close said outlet door upon releasing said dispenser button, said dispenser mechanism having a flexible spring portion extending therefrom against one interior wall of said container to return said button and BB door upon depressing and then releasing said button, whereby one or more BB's may be rapidly dispensed from said BB loader into the magazine of said air gun.

2. An air rifle BB loader in accordance with claim 1 in which said dispenser mechanism has two flexible spring portions extending therefrom against one wall of said container to return said button and BB door upon depressing and the releasing said button.

3. An air rifle BB loader in accordance with claim 2 in which said dispenser mechanism is movable pinned with a pair of pins for rotation thereon.

4. An air rifle BB loader in accordance with claim 3 in which said dispenser mechanism button has a plurality of gripping ridges thereon.

5. An air rifle BB loader in accordance with claim 4 in which said container has a plurality of flat walls tapering at one end to said BB outlet.

6. An air rifle BB loader in accordance with claim 5 in which said container cap is a press fitted cap.

* * * * *